US007499004B2

(12) United States Patent
Hsu

(10) Patent No.: US 7,499,004 B2
(45) Date of Patent: Mar. 3, 2009

(54) PLASMA DISPLAY PANELS AND METHODS FOR DRIVING PLASMA DISPLAY PANEL WITH REDUCED VOLTAGE NOTCHES

(75) Inventor: Horng-Bin Hsu, Taipei (TW)

(73) Assignee: Au Optronics Corp., Hsinchu (TW)

( * ) Notice: Subject to any disclaimer, the term of this patent is extended or adjusted under 35 U.S.C. 154(b) by 752 days.

(21) Appl. No.: 10/914,383

(22) Filed: Aug. 9, 2004

(65) Prior Publication Data

US 2006/0007061 A1 Jan. 12, 2006

(30) Foreign Application Priority Data

Jul. 12, 2004 (TW) ..... 93120766 A

(51) Int. Cl.
*G09G 3/28* (2006.01)

(52) U.S. Cl. ..... 345/67

(58) Field of Classification Search ..... 345/60–70
See application file for complete search history.

(56) References Cited

U.S. PATENT DOCUMENTS 6,288,691 B1 * 9/2001 Mikoshiba et al. ..... 345/60
6,559,814 B1 * 5/2003 Kanazawa et al. ..... 345/60
6,816,133 B2 * 11/2004 Tsai ..... 345/60
2002/0018033 A1 * 2/2002 Tanaka et al. ..... 345/60

* cited by examiner

*Primary Examiner*—Chanh Nguyen
*Assistant Examiner*—Bao-Quan T Ho
(74) *Attorney, Agent, or Firm*—Thomas, Kayden, Horstemeyer & Risley

(57) ABSTRACT

A method for driving a plasma display panel including first display electrodes, second display electrodes interleaved with the first display electrodes, an address electrode crossing over the first display electrodes and the second display electrode. The first display electrodes are sorted by the order into the even group and the odd group of the first display electrodes. A first sustain pulse pair formed by the sustain pulses are respectively applied to the even group of the first display electrode and the second display electrode. A second sustain pulse pair formed by the sustain pulses are respectively applied to the odd group of the first display electrode and the second display electrode. There is a phase difference between the sustain pulse applied to the even group of the first display electrode and that applied to the odd group of the first display electrode.

17 Claims, 10 Drawing Sheets

PLASMA DISPLAY PANELS AND METHODS FOR DRIVING PLASMA DISPLAY PANEL WITH REDUCED VOLTAGE NOTCHES

BACKGROUND OF THE INVENTION

1. Field of the Invention

The present invention relates in general to a method for driving a plasma display panel (PDP). In particular, the present invention relates to a method for driving a PDP by providing sustain pulses with phase difference in a sustain period.

2. Description of the Related Art

PDP displays images by indicates of charges accumulated through electrode discharge. It is one of the most interesting plate display devices because, among other advantages, it can provide a large screen and display full-color images.

FIG. 1 is a cross-section of a conventional PDP structure comprising two glass substrates 1 and 7 with components formed thereon. Inert gas, such as Ne, Xe, is filled in the cavity between glass substrates 1 and 7. The components formed on the glass substrate 1 include sustain electrodes $X_i$ and $X_{i+1}$ parallel to each other, and parallel scan electrodes $Y_i$ and $Y_{i+1}$ deposed between sustain electrodes, a dielectric layer 3 and a protective film 5. The distance between Xi and Yi is shorter than that between $Y_i$ and $X_{i+1}$ and $X_i$ and $Y_i$ are called an electrode pair ($X_i$, $Y_i$). Sustain electrode $X_{i+1}$ and scan electrode $Y_{i+1}$ form another electrode pair ($X_{i+1}$, $Y_{i+1}$). The components formed on the glass substrate 7 include address electrodes A perpendicular to sustain electrodes and scan electrodes and the fluorescent material 9 formed thereon.

In addition, gas discharges D1 and D2 occur between electrodes pairs ($X_i$, $Y_i$) and ($X_{i+1}$, $Y_{i+1}$), accordingly. Thus, one electrode pair provides one display line. A cell is defined at the intersection of an electrode pair and a data electrode.

FIG. 2 is a block diagram illustrating a plasma display formed by the PDP cells shown in FIG. 1. As shown in the drawing, the PDP 100 comprises the scan electrodes Y1~Yn, the sustain electrodes X1~Xn and the address electrodes A1~Am. In addition, the plasma display includes the control circuit 110, the Y scan drivers 112A and 112B, the X sustain driver 114 and the address driver 116. Y scan driver 112A generates waveforms in every period, and Y scan driver 112B generates scan pulses in address period only. The control circuit 110 generates control signals and image data signals for the drivers according to the external clock signal CLOCK, the image data signals DATA, the vertical synchronous signal VSYNC and the horizontal synchronous signal HSYNC, wherein the clock signal CLOCK represents the data transmittal clock, the image data signals DATA represents the image data, which is processed in control circuit 110 to be display data to fit the format for address driver, and the vertical synchronous signal VSYNC and the horizontal synchronous signal HSYNC respectively define the timing sequences of a frame and a scanning line. The display data is transmitted to the address driver 116 by the control circuit 110 and is written to each cell through the address electrodes A1~Am while the Y scan driver 112B sequentially scans the scan electrodes Y1~Yn in address period. The detailed operation is described below.

FIG. 3 is a diagram of a conventional PDP driving scheme to display a frame. As shown in the drawing, each frame is divided into eight sub-fields SF1~SF8. The PDP field displays various gray scales for all of the scanning lines. Each sub-field includes three operating periods, that is, the reset period R1~R8, the address period A1~A8 and the sustain period S1~S8. The reset period clears the residual charges of last sub-field and a certain amount of the wall charges remaining in each cell. The address period accumulates wall charges into the cell, which is to be displayed (i.e., turned ON), through address discharge. The sustain period sustains discharge for the cells which have accumulated charges through the address discharge. All of the PDP cells are processed at the same time during the reset period R1~R8 and the sustain periods S1~S8. The address operation is sequentially performed for scan electrode during the address period A1~A8. Moreover, the display brightness is proportional to the length of the sustain period S1~S8. In the example of FIG. 3, the length of the sustain periods S1~S8 of the sub-fields SF1~SF8 can be set at a ratio of 1:2:4:8:16:32:64:128 to display images in 256 gray scales.

FIG. 4 is a timing diagram of the driving waveform on the electrodes in a single sub-field of conventional process. The waveform on the address electrodes Ai is generated by the address driver 116, the waveform on the sustain electrodes X is generated by the X sustain driver 114, and the waveform on the scan electrodes Y1~Yn is generated by the scan driver 112A and 112B. As shown in the drawing, each sub-field includes the reset period, the address period and the sustain period. The waveform of each period and resulting behavior are described in detail below.

At time point a (in FIG. 4) of the reset period, the voltage of the scan electrodes Y1~Yn is set to 0 V, and a write pulse having a voltage of VS+VW is applied to the sustain electrode X, in which the voltage VS+VW exceeds the firing voltage between the sustain electrode X and the scan electrode Yi. Therefore, the global writing discharge W occurs between the sustain electrode X and the scan electrodes Y1~Yn. This discharge process accumulates negative charges on the sustain electrode X and positive charges on the scan electrodes Y1~Yn. The electric field produced by the accumulated negative charges and the positive charges cancels out the voltage drop between the sustain electrodes, thus the time of global writing discharge W is very short.

At time point b, the sustain electrode X is set to 0 V, and a sustain pulse 202 having a voltage of $V_S$ is applied to all of the scan electrodes Y1~Yn, wherein the value of the voltage $V_S$ plus the voltage caused by the charges accumulated between the sustain electrodes must exceed the firing voltage between the scan electrodes Yi and the sustain electrode X. Thus, the total sustain discharge S occurs between the sustain electrode X and the scan electrodes Y1~Yn. Unlike previous discharge process, this discharge process accumulates positive charges on the sustain electrode X and negative charges on the scan electrodes Yi.

At time point c, the scan electrodes Y1~Yn are set to 0V, an erase pulse 203 having a voltage lower than $V_S$ is applied to the sustain electrode X. The erase pulse neutralizes a part of the charges. On the scan electrodes Y1~Yn, required wall charges remain so that the write operation can proceed at a lower voltage in the subsequent address period.

In the address period, the voltage of the sustain electrode X and the scan electrodes Y1~Yn are pulled up to $V_S$ at time point d. Scan pulse 204 is then sequentially applied to the scan electrodes Y1~Yn from time point e, and an address pulse having a voltage of $V_A$ is applied to the address electrode A1~Am at the same time to cause write discharge. Wall charge is written into the corresponding cell and the corresponding cell is turned ON.

After scanning all of the scan electrodes Y1~Yn, the sustain period begins. The sustain electrode X and the scan electrode Yi are first set to 0 V. Sustain pulses 205 having the same voltage are then applied to the sustain electrode X and the scan electrodes Yi in an alternate way, i.e., at time point f and at time point g. Thus, the cell turned ON during the address period irradiates. It should be noted that the driving waveform described is only an example. The waveform varies in practice, but the same theory is applied.

FIGS. 5A~5D show waveforms of the pulses provided to the scan electrode and the sustain electrode of different types during the sustain period. FIG. 5A shows the scan electrode and the sustain electrode driven by "positive & no gap" mode during the sustain period. FIG. 5B shows the scan electrode and the sustain electrode driven by "positive & gap" mode during the sustain period. FIG. 5C shows the scan electrode and the sustain electrode driven by "negative & no gap" mode during the sustain period. FIG. 5D shows the scan electrode and the sustain electrode driven by "negative & gap" mode during the sustain period. In the figures, pulse X indicates the voltage provided to the sustain electrode varying with time, pulse Y indicates the voltage provided to the scan electrode varying with time, and pulse (X-Y) indicates the voltage difference between the sustain electrode and the scan electrode varying with time. As shown in FIGS. 5A~5D, the phase of the pulses provided to all sustain electrodes is the same, and the phase of the pulses provided to all scan electrodes is the same. In addition, the phase difference between the pulses respectively provided to the sustain electrode and the scan electrode is 180°.

However, PDP cells to be illuminated supplying the same voltage difference between the sustain electrode and the scan electrode induces gas discharge at the same time. Thus, the discharge current on the scan electrodes is great, especially when the numbers of the illuminated cell is large. In addition, the discharge current is greater when the percentage of Xe is increased. Thus, loading on the driving circuit of PDP is increased. In addition, the large discharge current generates notches on the waveform of the sustain pulse.

FIG. 6 shows the waveforms of the sustain pulses provided to the sustain electrode and the scan electrode, and the current on the scan electrode. In the figure, $X_{(V)}$ represents the voltage provided to the sustain electrode, $Y_{(V)}$ represents the voltage provided to the scan electrode, and $Y_{(I)}$ represents the current magnitude through the scan electrode. As shown in FIG. 6, currents 60 and 61 of the current waveform and notches 62 of the voltage waveform are generated on the scan electrode. Here, current 61 is called displacement current to charge or discharge the capacitive load of the panel in the sustain period.

However, the current 60 of the scan electrode cause notches 62 of the voltage generated on the scan electrode, and a driver having a higher current tolerance to drive the scan electrodes is required. In addition, the notches 62 of the voltage on the scan electrodes influence the gas discharge of PDP cells, causing cell extinction.

SUMMARY OF THE INVENTION

The object of the present invention is thus to provide a method to drive the illuminated cell by adjusting phases between sustain pulses, such that the instantaneous gas discharge current is decreased during the sustain period.

To achieve the above-mentioned object, the present invention provides a method for driving a plasma display panel having a pair of first display electrodes, a second display electrode interleaved with the first display electrodes, an address electrode crossing over the first display electrodes and the second display electrode, and a plurality of display cells between the first display electrodes and the second display electrode. The first display electrodes are sorted by the order into the even group and the odd group of the first display electrodes. The method comprises applying a first sustain pulse pair formed by the sustain pulses respectively applied to the even group of the first display electrodes and the second display electrode and applying a second sustain pulse pair formed by the sustain pulses respectively applied to the odd group of the first display electrodes and the second display electrode, wherein there is a phase difference between the sustain pulse applied to the even group of the first display electrodes and the sustain pulse applied to the odd group of the first display electrodes, and the display cells on both sides of the second display electrode are illuminated by discharging in a sustain period.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

First Embodiment

Figure 1:
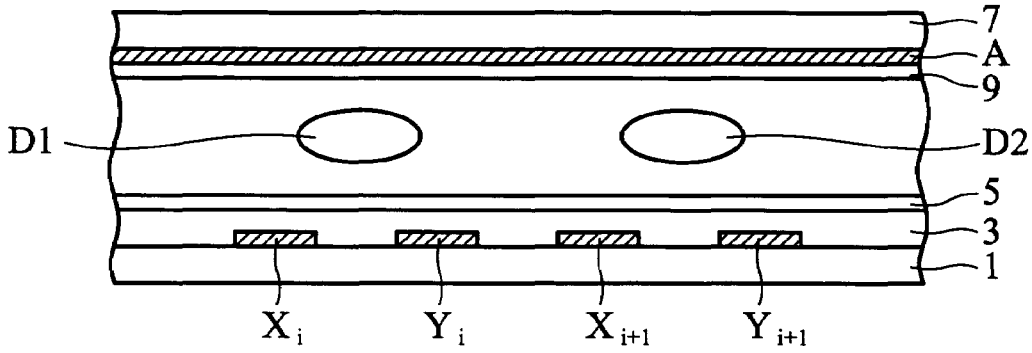
FIG. 1 ( RELATED ART )
FIG. 1 is a cross-section of a conventional PDP structure comprising two glass substrates 1 and 7 and the components formed thereon.
Figure 2:
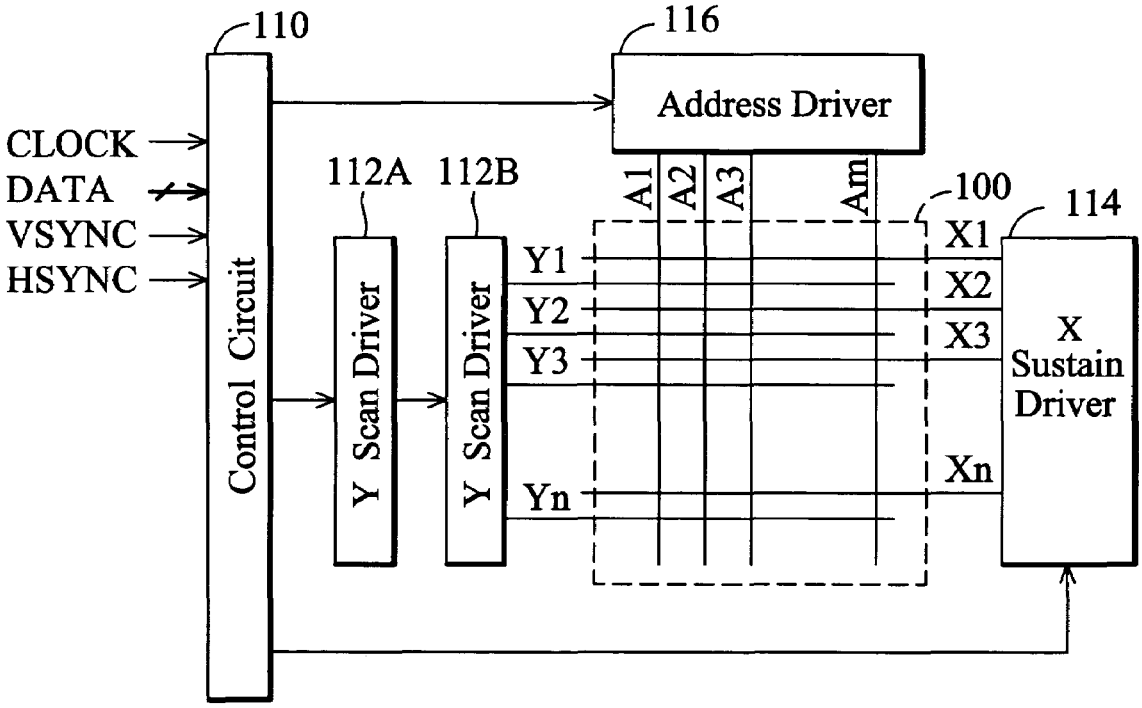
FIG. 2 ( RELATED ART )
FIG. 2 is a block diagram illustrating a plasma display system.
Figure 3:
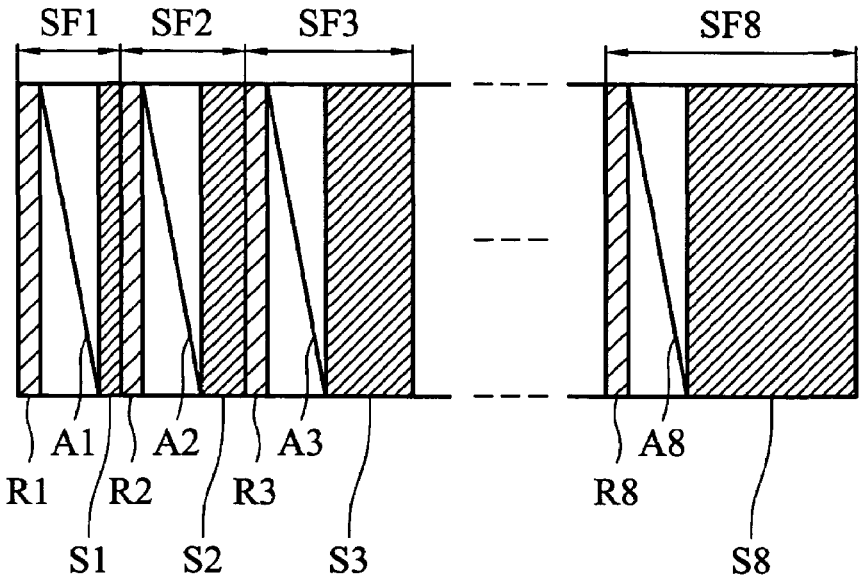
FIG. 3 ( RELATED ART )
FIG. 3 is a diagram of a conventional PDP driving scheme to display a frame.
Figure 4:
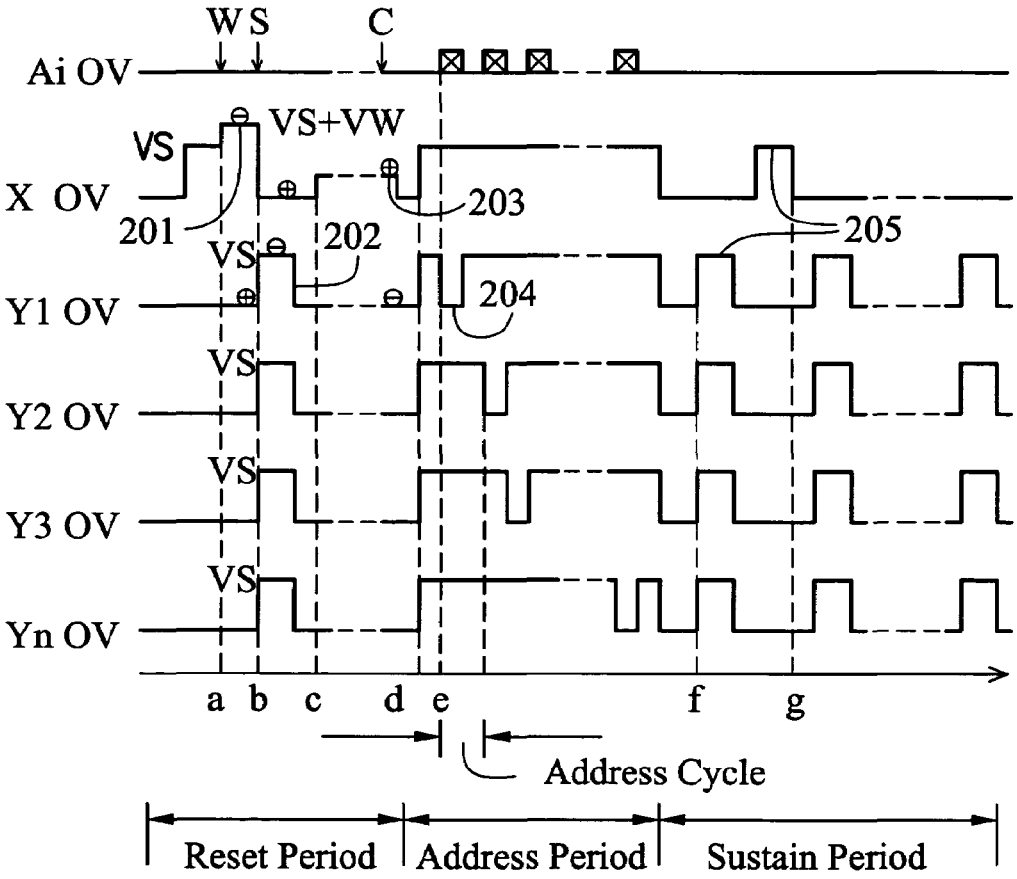
FIG. 4 ( RELATED ART )
FIG. 4 is the driving waveform of a single sub-field.
Figure 5A:
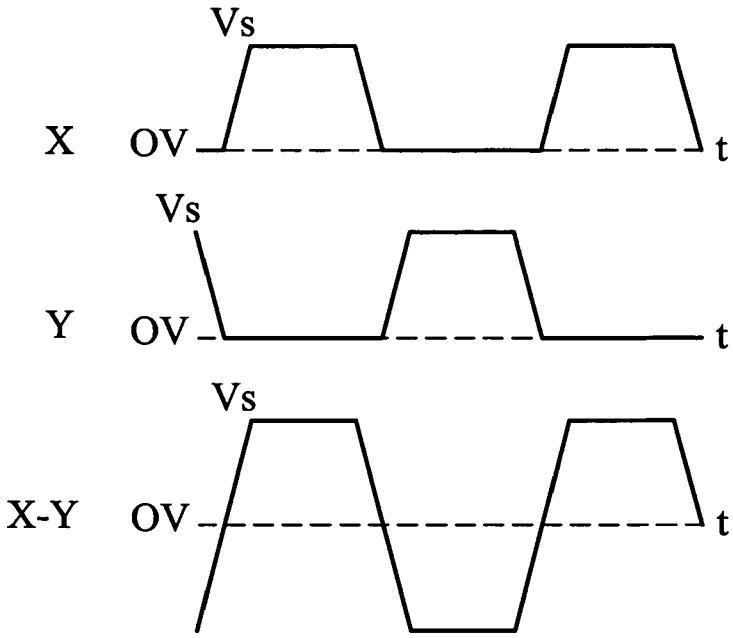
FIG. 5A ( RELATED ART )
FIGS. 5A~5D show waveforms of the sustain pulses provided to the scan electrode and the sustain electrode of different types during the sustain period.
Figure 5B:
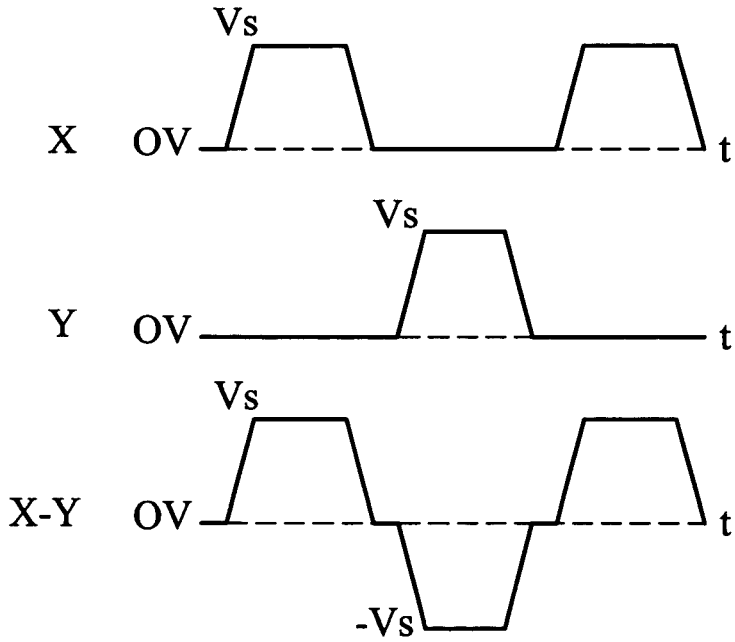
FIG. 5B ( RELATED ART )
Figure 5C:
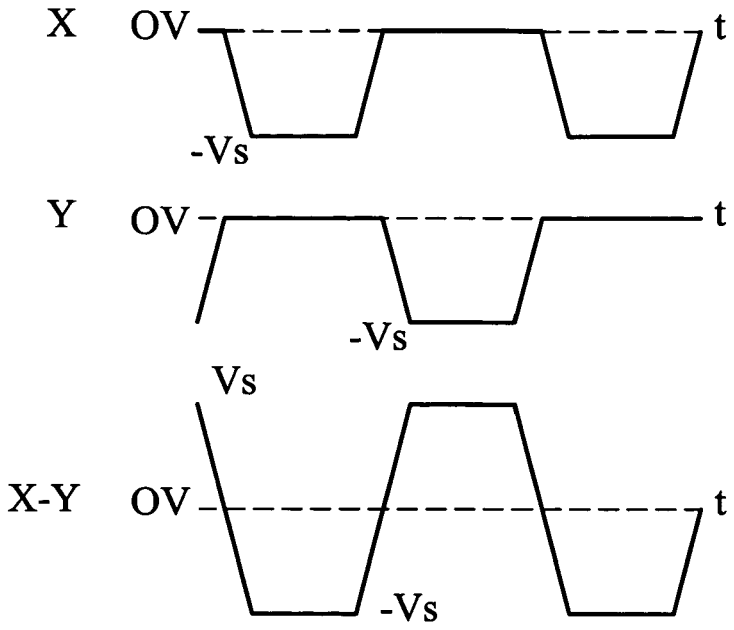
FIG. 5C ( RELATED ART )
Figure 5D:
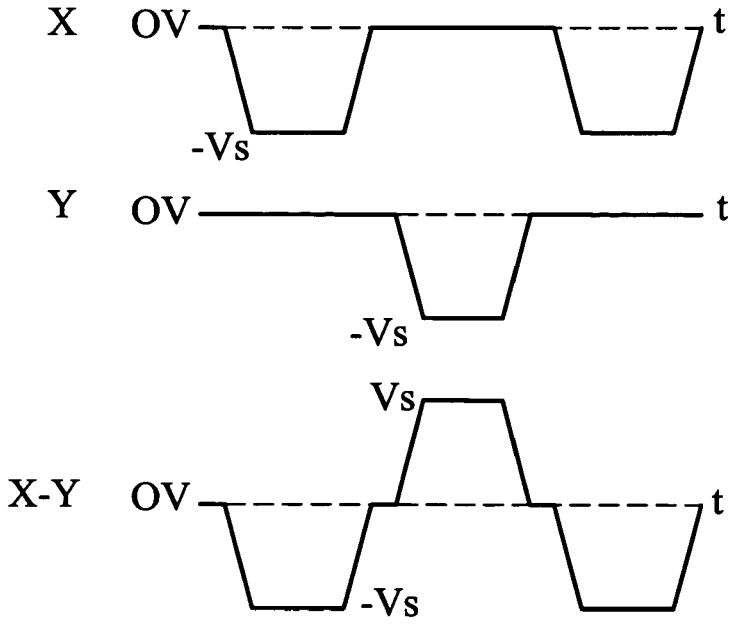
FIG. 5D ( RELATED ART )
Figure 6:
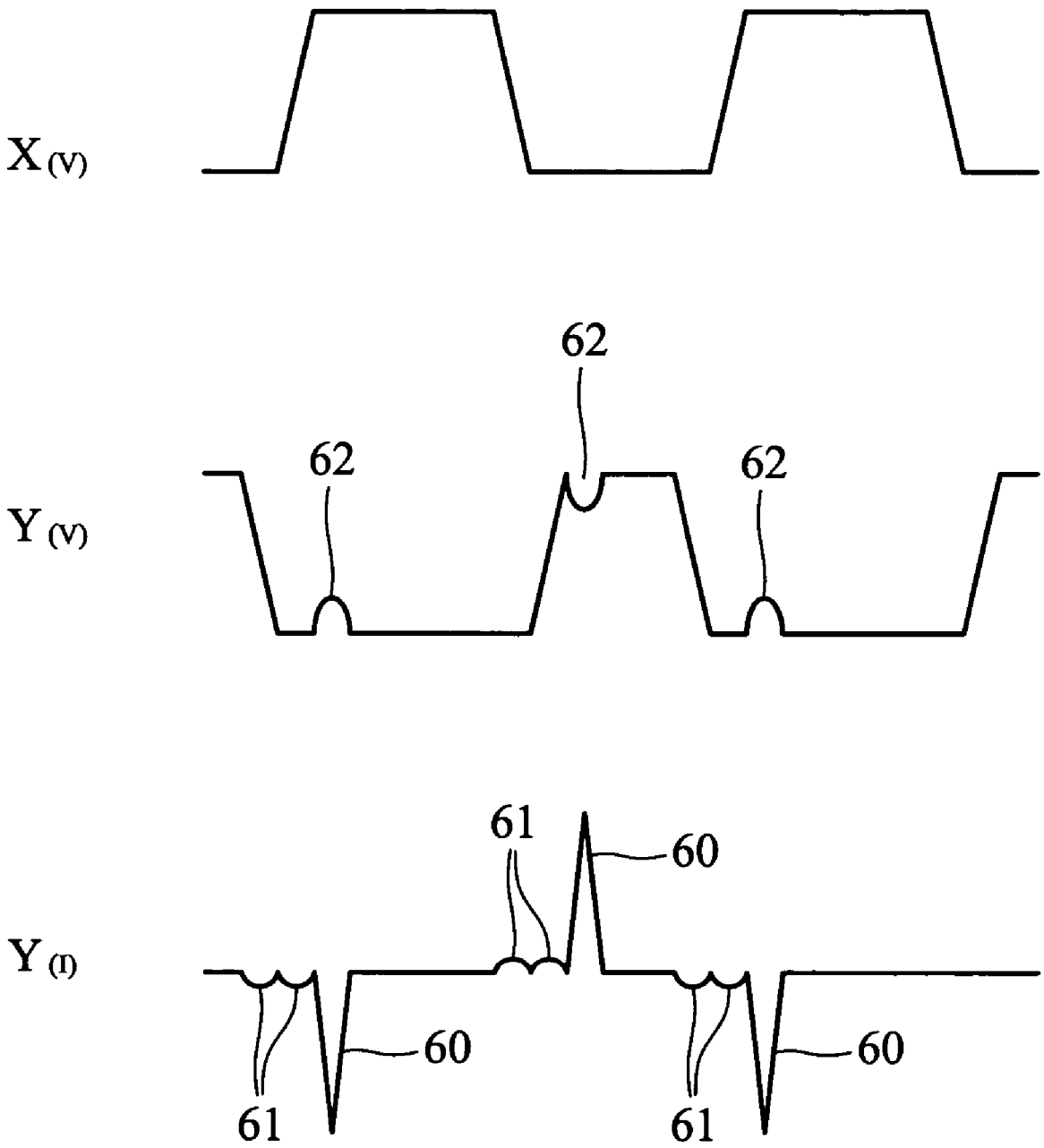
FIG. 6 shows the waveforms of the sustain pulses provided to the sustain electrode and the scan electrode, and the current on the scan electrode.
Figure 7:
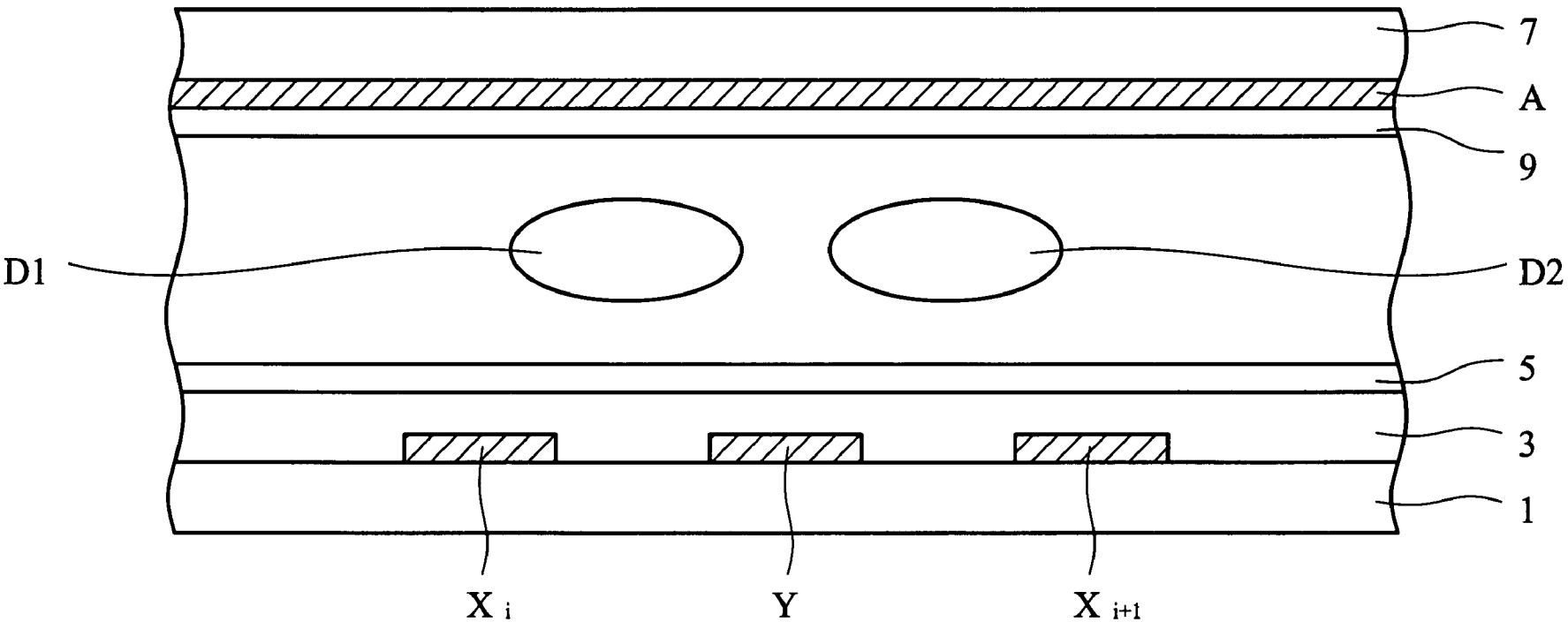
FIG. 7 is a cross-section of a PDP structure comprising two glass substrates 1 and 7 and the components formed thereon according to the present invention.

FIG. 7 is a cross-section of a PDP structure comprising two glass substrates 1 and 7 and the components formed thereon according to the present invention. Inert gas, such as Ne, Xe, is filled in the cavity between glass substrates 1 and 7. The components formed on the glass substrate 1 include sustain electrodes $X_i$ and $X_{i+1}$, and parallel scan electrodes Y, a dielectric layer 3 and a protective film 5. The components formed on the glass substrate 7 include address electrodes A perpendicular to sustain electrodes and scan electrodes, and the fluorescent material 9 formed thereon. Thus, each PDP cell includes three kinds of electrodes, i.e., sustain electrodes ($X_i$ or $X_{i+1}$) and parallel scan electrodes Y which are parallel to each other, and perpendicular address electrodes A. In addition, gas discharges D1 and D2 are occurred in lines defined by electrodes. In practice, a voltage is applied to the scan electrode Y and the sustain electrode $X_i$. This induces discharge D1. When a voltage is applied to the scan electrode Y and the sustain electrode $X_{i+1}$, the discharge D2 is induced. Thus, one electrode provides display lines on both sides thereof.

Figure 8:
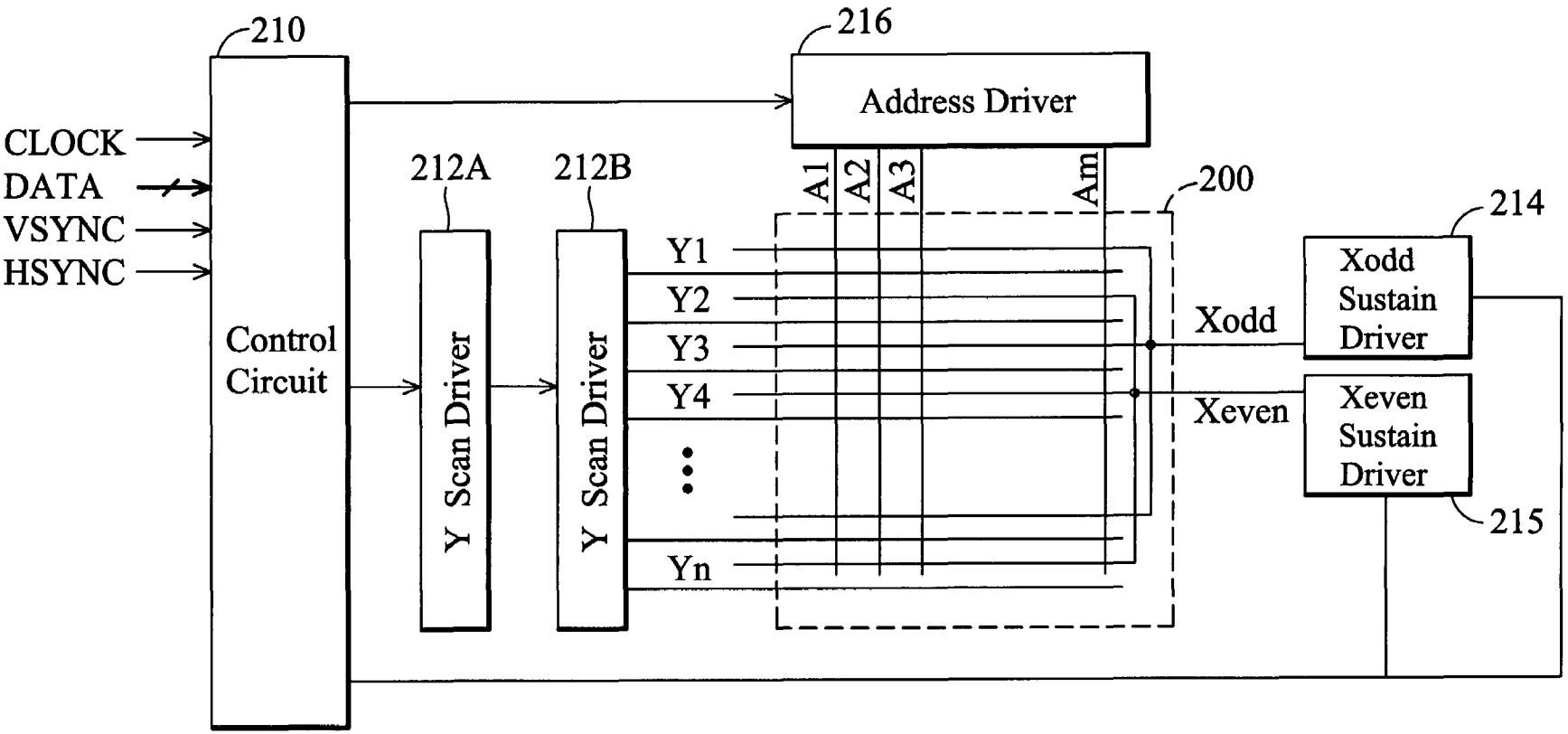
FIG. 8 is a block diagram of a plasma display system according to the first embodiment of the present invention.
Figure 9:
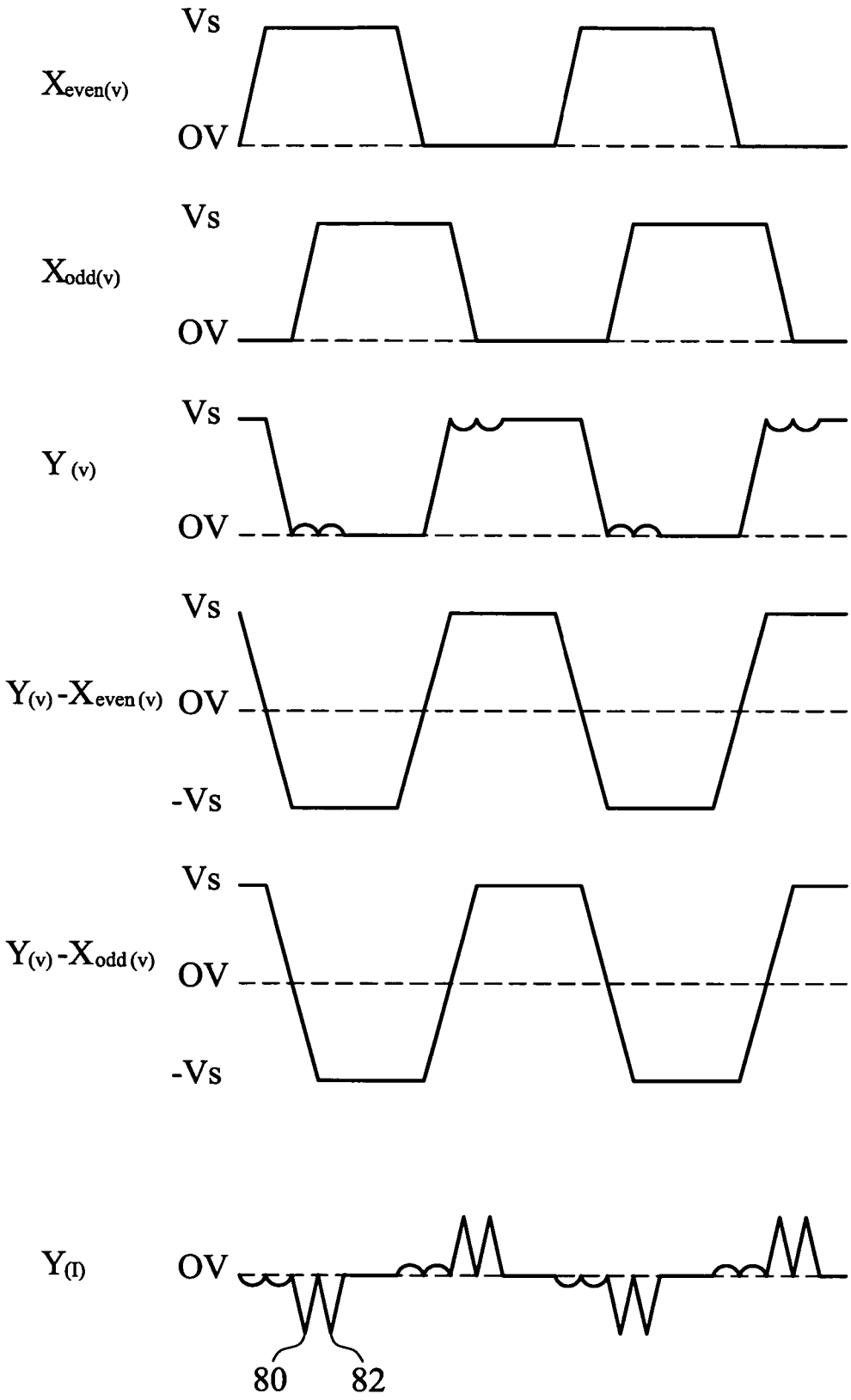
FIG. 9 shows waveforms of the sustain pulses provided to the scan electrode and the sustain electrode in the sustain period according to the first embodiment of the present invention.

FIG. 8 is a block diagram of a plasma display according to the first embodiment of the present invention. As shown in the drawing, the PDP 200 comprises of the scan electrodes Y1~Yn, the first sustain electrodes Xeven and the second sustain electrodes Xodd, and the address electrodes A1~Am. In addition, the plasma display includes the control circuit 210, the Y sustain drivers 212A and 212B, the Xodd sustain driver 214, the Xeven sustain driver 215 and the address driver 216. Y scan driver 212A generates waveforms in every period, and Y scan driver 212B generates scan pulses in address period only. The control circuit 210 generates control signals and image data signals for the drivers according to the external clock signal CLOCK, the image data signals DATA, the vertical synchronous signal VSYNC and the horizontal synchronous signal HSYNC, wherein the clock signal CLOCK represents the data transmittal clock, the image data signal DATA represents the image data, and the vertical synchronous signal VSYNC and the horizontal synchronous signal HSYNC are respectively define the timing sequences of a frame and a scanning line. The display data is transmitted to the address driver 216 by the control circuit 210 and is written to each cell through the address electrodes A1~Am while the Y scan driver 212B sequentially scans the scan electrodes Y1~Yn in address period. In the sustain period, sustain pulses are provided between the scan electrodes Y1~Yn and the sustain electrodes Xeven and Xodd. FIG. 9 shows waveforms of the sustain pulses provided to the scan electrode and the sustain electrode in the sustain period according to the first embodiment of the present invention. It is noted that while the scan electrodes and the sustain electrodes are driven by "positive & no gap" mode in the present embodiment, the waveform of the sustain pulse can vary in practice, such as "positive & gap" mode, "negative & no gap" mode, and "negative & gap" mode, and the same theory is applied.

In the figures, $X_{even(V)}$ indicates the sustain pulses provided to the first sustain electrode Xeven varying with time, $X_{odd(V)}$ indicates the sustain pulses provided to the second sustain electrode Xodd varying with time, $Y_{(V)}$ indicates the sustain pulses provided to the scan electrode varying with time, $(X_{even}\text{-}Y_{(V)})$ indicates the voltage difference between the first sustain electrode Xeven and the Y scan electrode varying with time, $(X_{odd}\text{-}Y_{(V)})$ indicates the voltage difference between the second sustain electrode Xodd and the Y sustain electrode varying with time and $Y_{(I)}$ represents the current magnitude through the scan electrode. In addition, the current Y(I) represents the current flowing through a single sustain electrode, not all scan electrodes. As shown in FIG. 9, the phase of the sustain pulses provided to all scan electrodes is the same, but there is a phase difference between the sustain pulses provided to the first sustain electrodes and the second sustain electrodes.

As shown in FIG. 9 gas discharge current 80 and 82 of the current waveform $Y_{(I)}$ are generated on the scan electrode. Gas discharge current 80 is caused by the gas discharge between first sustain electrode Xeven and the Y scan electrode, and gas discharge current 82 is caused by the gas discharge between second sustain electrode Xodd and the Y scan electrode. Gas discharge current 80 and gas discharge current 82 occur at different time as a result of the phase difference between the pulses supplied to the first sustain electrodes Xeven and the second sustain electrodes Xodd. The peak magnitude of the gas discharge current on the scan electrode is reduced to half due to the gas discharge current divergence in time domain. Meanwhile, the magnitude of notch is also reduced to half and it will benefit to improve the gas discharge stability and uniformity. In addition, the peak discharge current on the sustain electrode is reduced to half, such that the instantaneous discharge current is decreased during the sustain period. Thus, the requirement for current rating of the driver ICs of the scan driver 312B for the scan electrodes is reduced, and loading on the Y scan driver 312A is decreased.

Second Embodiment

Figure 10:
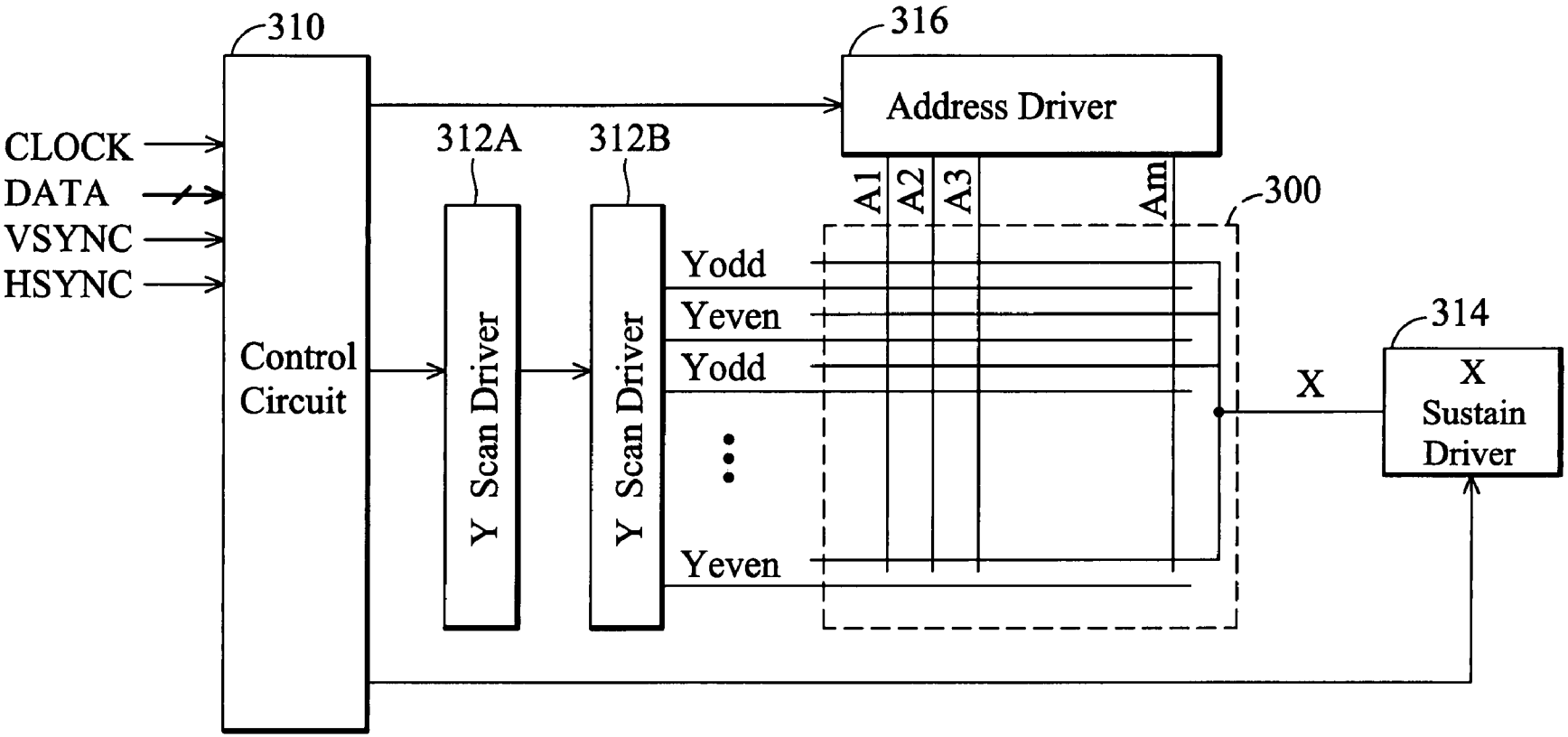
FIG. 10 is a block diagram of a plasma display system according to the second embodiment of the present invention.

FIG. 10 is a block diagram of a plasma display according to the second embodiment of the present invention. As shown in the drawing, the PDP 300 comprises of the first scan electrodes Yeven and the second scan electrodes Yodd, the sustain electrodes X, and the address electrodes A1~Am. In addition, the plasma display includes the control circuit 310, the Y scan drivers 312A and 312B, the X sustain driver 314, and the address driver 316. Y scan driver 312A generates waveforms in every period, and Y scan driver 312B generates scan pulses in address period only. The control circuit 310 generates control signals and image data signals for the drivers according to the external clock signal CLOCK, the image data signals DATA, the vertical synchronous signal VSYNC and the horizontal synchronous signal HSYNC, wherein the clock signal CLOCK represents the data transmittal clock, the image data signal DATA represents the image data, and the vertical synchronous signal VSYNC and the horizontal synchronous signal HSYNC are respectively define the timing sequences of a frame and a scanning line. The display data is transmitted to the address driver 316 by the control circuit 310 and is written to each cell through the address electrodes A1~Am while the Y scan driver 312B sequentially scans the scan electrodes Yeven and Yodd in address period. In the sustain period, sustain pulses are provided between the scan electrodes Yeven and Yodd and the sustain electrodes X.

Figure 11:
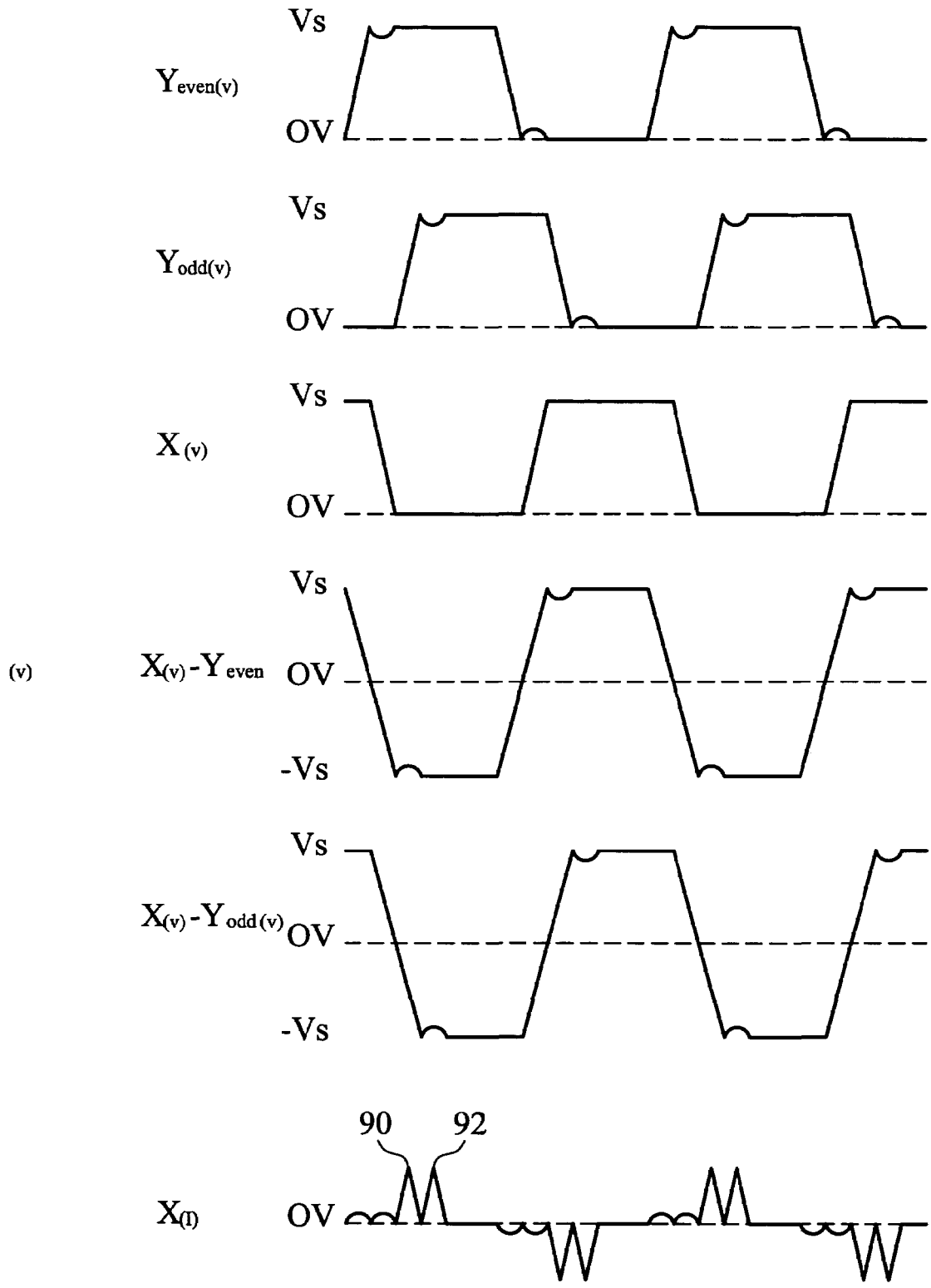
FIG. 11 shows waveforms of the sustain pulses provided to the scan electrode and the sustain electrode in the sustain period according to the second embodiment of the present invention.

FIG. 11 shows waveforms of the sustain pulses provided to the scan electrode and the sustain electrode in the sustain period according to the first embodiment of the present invention. It is noted that while the scan electrodes and the sustain electrodes are driven by "positive & no gap" mode in the present embodiment, the waveform of the sustain pulse can vary in practice, such as "positive & gap" mode, "negative & no gap" mode, and "negative & gap" mode, and the same theory is applied.

In the figures, $Y_{even(V)}$ indicates the sustain pulses provided to the first scan electrode Yeven varying with time, $Y_{odd(V)}$ indicates the sustain pulses provided to the second scan electrode Yodd varying with time, $X_{(V)}$ indicates the sustain pulses provided to the sustain electrode varying with time, $(Y_{even}\text{-}X_{(V)})$ indicates the voltage difference between the first scan electrode Yeven and the X sustain electrode varying with time, $(Y_{odd}\text{-}X_{(V)})$ indicates the voltage difference between the second scan electrode Yodd and the X sustain electrode varying with time, and $X_{(I)}$ represents the current magnitude through the sustain electrode. In addition, the current $X_{(I)}$ represents the current flowing through a single sustain electrode, not all sustain electrodes. As shown in FIG. 11, the phase of the sustain pulses provided to all sustain electrodes is the same, but there is a phase difference between the sustain pulses provided to the first scan electrodes and the second scan electrodes.

As shown in FIG. 11, gas discharge current 90 and 92 of the current waveform $X_{(I)}$ are generated on the sustain electrode.

Gas discharge current 90 is caused by the gas discharge between first scan electrode Yeven and the sustain electrode X, and gas discharge current 92 is caused by the gas discharge between second scan electrode Yodd and the sustain electrode X. Gas discharge current 90 and gas discharge current 92 occur at different time as a result of the phase difference between the pulses supplied to the first scan electrodes Yeven and the second scan electrodes Yodd. The peak magnitude of the gas discharge current on the scan electrode is reduced to half due to the gas discharge current divergence in time domain. Meanwhile, the magnitude of notch is also reduced to half and it will benefit to improve the gas discharge stability and uniformity. In addition, the peak discharge current on the sustain electrode is reduced to half, such that the instantaneous discharge current is decreased during the sustain period. Thus, loading on the X sustain driver 314 is decreased.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A method for driving a plasma display panel having a plurality of first display electrodes sorted by the order into a even group and an odd group of the first display electrodes, a plurality of second display electrodes interleaved with the first display electrodes, a plurality of address electrodes crossing over the first display electrodes and the second display electrodes, and a plurality of display cells between the first display electrodes and the second display electrode, the method comprising the steps of:

applying a first sustain pulse pair formed by the sustain pulses respectively applied to the even group of the first display electrodes and the second display electrode; and applying a second sustain pulse pair formed by the sustain pulses respectively applied to the odd group of the first display electrodes and the second display electrode, wherein there is a phase difference between the sustain pulse applied to the even group of the first display electrodes and the sustain pulse applied to the odd group of the first display electrodes, and the display cell disposed on one of the address electrodes and across one of the second display electrode and one of the odd group first display electrodes, and the display cell disposed on the same address electrode and across the same second display electrode and one of the even group first display electrodes are both illuminated within a predetermined time interval by discharging in a sustain period.

2. The method for driving a plasma display panel as claimed in claim 1, wherein the first display electrodes are sustain electrodes.

3. The method for driving a plasma display panel as claimed in claim 1, wherein the second display electrode is a scan electrode.

4. The method for driving a plasma display panel as claimed in claim 1, wherein the first display electrodes are scan electrodes.

5. The method for driving a plasma display panel as claimed in claim 1, wherein the second display electrode is a sustain electrode.

6. The method for driving a plasma display panel as claimed in claim 1, wherein the pulses respectively applied to the both even group and odd group first display electrodes have the phase difference.

7. A method for driving a plasma display panel having a plurality of first sustain electrodes, a plurality of second sustain electrodes, a plurality of scan electrodes interleaved with the first sustain electrodes and the second sustain electrodes, an address electrode crossing over the first sustain electrodes, the second sustain electrodes and the scan electrodes, and a plurality of display cells between the first sustain electrode and the scan electrode, and the second sustain electrode and the scan electrode, the method comprising the steps of:

applying a first sustain pulse pair formed by the sustain pulses respectively applied to the first sustain electrode and the scan electrode; and applying a second sustain pulse pair formed by the sustain pulses respectively applied to the second sustain electrode and the scan electrode, wherein there is a phase difference between the first sustain pulse pair and the second sustain pulse pair, and the display cell disposed on the address electrode and across one of the scan electrodes and one of the first sustain electrodes, and the display cell disposed on the address electrode and across the same scan electrode and one of the second sustain electrodes are both illuminated within a predetermined time interval by discharging in a sustain period.

8. The method for driving a plasma display panel as claimed in claim 7, wherein the pulses respectively applied to the first sustain electrode and the second sustain electrode have the phase difference.

9. A driving apparatus for a plasma display panel having a plurality of first sustain electrodes, a plurality of second sustain electrodes, a plurality of scan electrodes interleaved with the first sustain electrodes and the second sustain electrodes, a plurality of address electrodes crossing over the first sustain electrodes, the second sustain electrodes and the scan electrodes, and a plurality of display cells between the first sustain electrode and the scan electrode, and the second sustain electrode and the scan electrode, the driving apparatus comprising:

a control circuit for receiving external display data and relevant clock data;

an address driver connected to the control circuit driving the address electrode;

a scan driver connected to the control circuit providing pulses to the scan electrode;

a sustain driver connected to the control circuit applying a first sustain pulse to the first sustain electrode, and a second sustain pulse to the second sustain electrode, wherein there is a phase difference between the first sustain pulse and the second sustain pulse, and the display cell disposed on one of the address electrodes and across one of the scan electrode and one of first sustain electrodes, and the display cell disposed on the same address electrode and across the same second display electrode and one of the second sustain electrodes are both illuminated within a predetermined time interval by discharging in a sustain period.

10. The driving apparatus as claimed in claim 9, wherein the scan electrode is interleaved with the first sustain electrode and the second sustain electrode.

11. The method for driving a plasma display panel as claimed in claim 1, wherein a waveform and a phase of the signals provided to the second display electrodes are identical, and the phase difference between the sustain pulse applied to the even group of the first display electrodes and the sustain pulse applied to the odd group of the first display electrodes exceeds 0 degree and less than 90 degree in the sustain period.

12. The method for driving a plasma display panel as claimed in claim 7, wherein a waveform and a phase of the signals provided to the scan electrodes are identical, and the phase difference between the first sustain pulse pair and the second sustain pulse pair exceeds 0 degree and less than 90 degree in the sustain period.

13. The driving apparatus as claimed in claim 9, wherein the phase difference between the first sustain pulse and the second sustain pulse exceeds 0 degree and less than 90 degree in the sustain period.

14. The driving apparatus as claimed in claim 9, wherein a waveform and a phase of the signals provided to the scan electrodes are identical in the sustain period.

15. The method for driving a plasma display panel as claimed in claim 1, wherein a first voltage difference of a first voltage applied to the second display electrode and a second voltage applied to the first display electrode adjacent on one side of the second display electrode, and a second voltage difference of the first voltage and a third voltage applied to the first display electrode adjacent on another side of the second display electrode exceed a predetermined voltage level within the predetermined time interval.

16. The method for driving a plasma display panel as claimed in claim 7, wherein a first voltage difference of a first voltage applied to the scan electrode and a second voltage applied to the first sustain electrode adjacent on one side of the scan electrode, and a second voltage difference of the first voltage and a third voltage applied to the second sustain electrode adjacent on another side of the scan electrode exceed a predetermined voltage level within the predetermined time interval.

17. The driving apparatus as claimed in claim 9, wherein a first voltage difference of a first voltage applied to the scan electrode and a second voltage applied to the first sustain electrode adjacent on one side of the scan electrode, and a second voltage difference of the first voltage and a third voltage applied to the second sustain electrode adjacent on another side of the scan electrode exceed a predetermined voltage level within the predetermined time interval.

* * * * *